United States Patent [19]

Wyland et al.

[11] 4,070,144

[45] Jan. 24, 1978

[54] CONTROL SYSTEM

[75] Inventors: Alvin D. Wyland, Morrison, Ill.; Jaykishan C. Patel, Liverpool, N.Y.

[73] Assignee: General Electric Company, Fort Wayne, Ind.

[21] Appl. No.: 653,803

[22] Filed: Jan. 30, 1976

[51] Int. Cl.[2] ..... F23N 5/08

[52] U.S. Cl. ..... 431/79

[58] Field of Search ..... 60/39.14, 39.28 R, 223; 431/79, 78, 80, 66, 67, 68

[56] References Cited

U.S. PATENT DOCUMENTS

| | | | |
|---|---|---|---|
| 3,365,881 | 1/1968 | McKenzie | 60/223 |
| 3,600,887 | 8/1971 | Gault | 60/223 |
| 3,691,759 | 9/1972 | Scheerer | 60/39.28 R |
| 3,734,676 | 5/1973 | Wyland | 431/79 |
| 3,832,123 | 8/1974 | Walbridge | 431/78 |
| 3,872,320 | 3/1975 | Juskewicz | 307/117 |

*Primary Examiner*—Clarence R. Gordon
*Attorney, Agent, or Firm*—Joseph E. Papin

[57] ABSTRACT

A control system for a fuel flow control valve which is enabled on thermostatic demand and closed thereafter if ignition fails. The control system includes an enabling circuit for the control valve in series with a controlled switching device and a circuit for energizing a fuel igniting system. The control system also includes circuitry for selectively supplying enabling pulses to the controlled switching device to enable the control valve and to energize the fuel igniting system along with timing circuitry for selectively preventing the application of those enabling pulses to the controlled switching device. The timing circuitry includes a transistor which when enabled shunts those pulses to ground rather than to the controlled switching device, and the control system is fail safe in the sense that neither a shorted transistor nor a shorted controlled switching device will allow the escape of significant unburned fuel.

13 Claims, 1 Drawing Figure

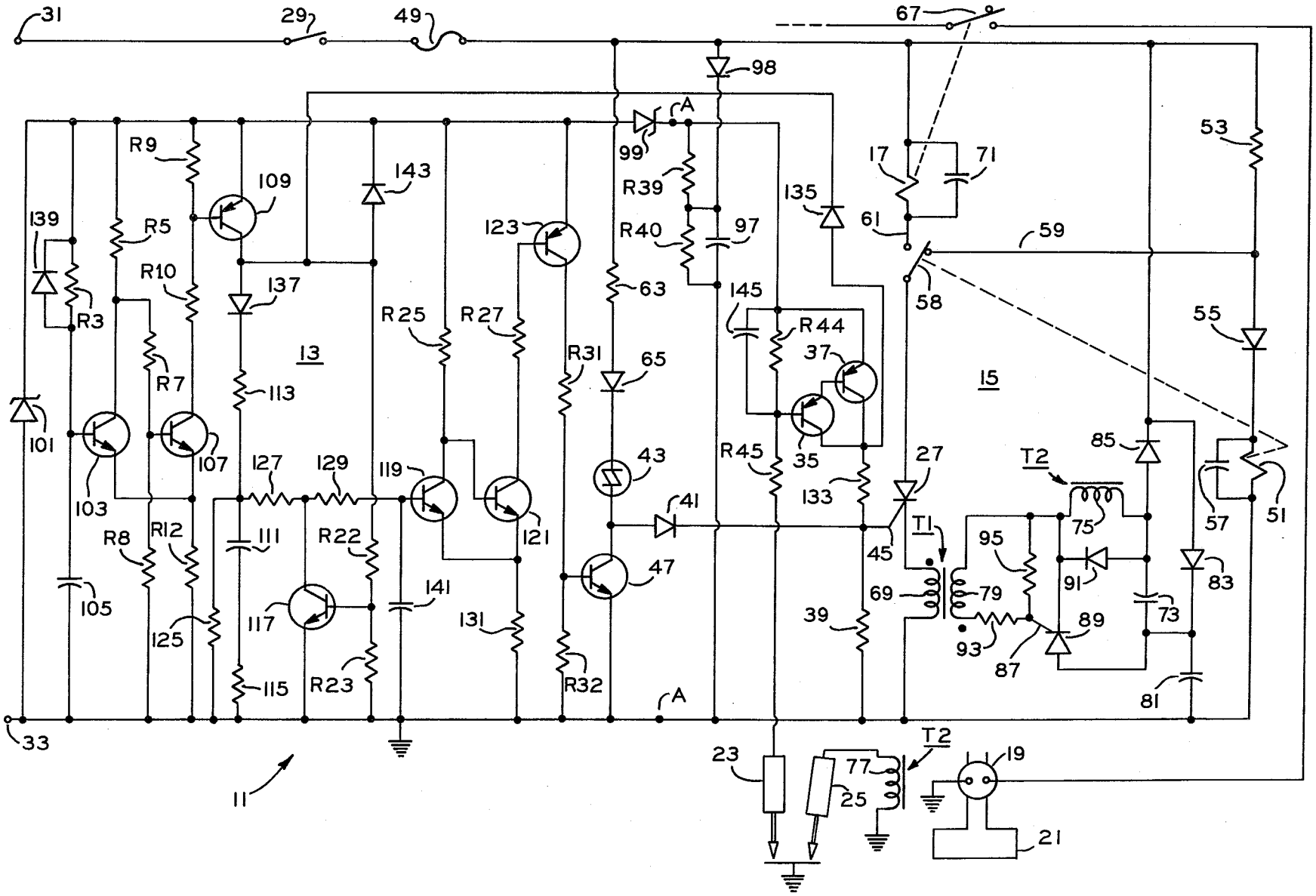
53
55
51
57
83
73
81
85
75
91
89
T2
95
79
93
87
59
15
71
67
17
61
58
27
T1
45
69
39
133
37
35
R44
R45
145
135
98
97
R39
R40
99
A
63
65
43
41
47
R31
R32
123
121
R27
131
R25
119
141
143
49
29
R22
R23
129
13
109
137
113
127
111
117
115
107
R9
R5
R10
R7
R12
125
R8
103
105
R3
139
101
31
33
11
19
21
T2
77
25
23

CONTROL SYSTEM

BACKGROUND OF THE INVENTION

The present invention relates generally to control systems and more particularly to a control system of the direct ignition type.

In the past, control systems for fuel burners, such as gas furnaces and the like, typically employed a thermostat to open a fuel valve on demand for heat and also typically employed means for automatically igniting the fuel emitted from the burner. Ignition was sometimes achieved by a small continuously burning pilot flame or by using a spark or arc igniter to provide a spark in the vicinity of the burner at about the same time or soon after the fuel valve was opened.

An improvement in control systems for fuel burners is illustrated in U.S. Pat. No. 3,734,676. In this patented control system, an igniter and a controlled switching device are effective when gated to connect the igniter to a source of electrical energy for providing pulses of electrical energy to the igniter. This patented control system has a gate circuit including a capacitance for providing gate signals to the controlled switching device. These gate signals are provided so long as the capacitance has a charge below a specified level and the capacitance is initially provided with a charge above that specified level. The capacitance charge is reduced with time so as to gate the controlled switching device to operatively connect the igniter to a source of electrical energy only after a predetermined period of energization of the control system thereby to effect preignition purging of the burner area to insure that there is not an over abundance of fuel when ignition occurs.

Control systems of the type illustrated in the aforementioned U.S. Patent typically operate on a 120 volt alternating current supply or employ a step-up transformer from the commonly encountered low voltage thermostat systems which typically operate around 24 volts alternating current. U.S. Pat. No. 3,920.376 and a copending application Ser. No. 504,252 filed Sept. 9, 1974, now U.S. Pat. No. 3,938,941, also disclose control systems which are amenable to direct energization by the aforementioned low voltage thermostat systems.

SUMMARY OF THE INVENTION

Among the several objects of the present invention may be noted the provision of an improved control system for a fuel burner; the provision of such control system which will not initiate the supply of fuel and attempt for ignition if one or more of the semiconductor devices therein are shorted; the provision of a fuel burner control system employing an enabling pulse circuit and a timing circuit for selectively preventing those enabling pulses from being effective; and the provision of such control system characterized by its reliability of performance, simplicity of design, and economy of manufacture. These as well as other objects and features of the present invention will be in part apparent and in part pointed out hereinafter.

In general and in one form of the invention, a control system for a fuel burner has a fuel flow control valve and means for enabling the control valve. A fuel igniting system, means for energizing the fuel igniting system, and a controlled switching device are provided and all adapted for connection in series with an electrical source. A control circuit includes means for selectively supplying enabling pulses to the controlled switching device to energize the fuel igniting system and tuning means for selectively preventing the application of the enabling pulses to the controlled switching device.

Further in general and in one form of the invention, a control system for a combustible fuel burner having a fuel flow control valve is provided with means for actuating the control valve to effect flow of the combustible fuel to the fuel burner. Means is associated with the fuel burner for igniting the fuel emitted therefrom, and means is also associated with the fuel burner for indicating when a flame is present. A controlled switching device is provided, and means is operable for connecting the actuating means and the controlled switching device to a source of electrical energy to effect the energization of the actuating means when the controlled switching devices becomes conductive. Means is responsive to the indicating means when a flame is present at a fuel burner for continuously enabling the controlled switching device. Means is also provided for selectively supplying enabling pulses to the controlled switching device, and timing means is provided for selectively preventing the application of the enabling pulses to the controlled switching device.

BRIEF DESCRIPTION OF THE DRAWING

The drawing is a detailed schematic diagram of a control system in one form of the invention.

Corresponding reference characters indicate corresponding parts throughout the drawing.

The exemplifications set out herein illustrate the preferred embodiment of the invention in one form thereof, and such exemplifications are not to be construed as limiting in any manner the scope of the invention.

DESCRIPTION OF THE PREFERRED EMBODIMENT

Referring now to the drawing in detail, there is illustrated generally at 11 a control system in one form of the invention which is provided with a lock out or timing portion or circut 13 generally to the left of reference points A in the drawing and an ignition, flame sensing and valve actuating portion or circuit 15 generally to the right of reference points A. More particularly, control system 11 includes means, such as relay coil 17, for actuating a fuel flow control valve 19 to effect the flow of a combustible fuel from a fuel burner 21, means, such as a detector probe 23, for indicating the presence of a flame at the fuel burner, and means, such as a spark probe 25, for igniting fuel emitted from the burner. A controlled switching device, such as a silicon controlled rectifier 27, is connected in series with the actuating means or actuating coil 17 and a thermostatic switch 29 to a source of electrical energy generally constituted by a pair of power terminals 31, 33. Thus, when thermostatic switch 29 closes and silicon controlled rectifier 27 is gated to conduction, actuating coil 17 is energized. When a flame is present at fuel burner 21, the impedance between the flame detector probe 23 and ground is substantially less than the impedance therebetween when the flame is not present; therefore, such a lowered impedance allows a substantial increase in the base current of a transistor 35 which in turn causes a transistor 37 to substantially saturate with an associated voltage drop across a resistor 39 functioning to continuously enable silicon controlled rectifier 27. Silicon controlled switching rectifier 27 also, and quite independently, may be selectively supplied enabling pulses by way of a diode 41 when a semiconductor device of Diac 43 breaks down due to its threshold voltage having been exceeded somewhere midway in a positive half cycle of an alternating current supply. Timing circuit 13 may prevent the application of these enabling pulses to a gate 45 of silicon controlled rectifier 27 if another controlled switching device, such as a transistor 47, is conducting to bypass those enabling pulses from controlled switching device 27. Transistor 47 will typically be conducting during a first time interval following initial energization of control pulses, and during a second subsequent time interval, the transistor will be nonconducting to allow those pulses to be applied to silicon controlled rectifier 27. Further, during a third and still later time interval, transistor 47 will again be conducting to prevent the application of enabling pulses to silicon controlled rectifier 27. Diode 41 allows the enabling pulses to reach gate 45 of silicon controlled rectifier 27 when transistor 47 is nonconducting and also allows the voltage drop across resistor 39 to enable the silicon controlled rectifier even though the transistor may be conducting.

Assuming that an alternating current is supplied across power terminals 31, 33 and that thermostatic switch 29 has closed so as to call for the actuation of fuel burner 21, current will flow through a protective fuse 49 to energize a relay coil 51 by way of a resistor 53 and a diode 55. A capacitor 57 functions to delay and filter the halfwave current reaching coil 51, and upon energization, coil 51 causes a blade 58 to break from a line or contact 59 and make with another line or contact 61. At this time, transistor 47 is conducting and shorting to ground the line synchronous pulses through Diac 43, and transistors 35, 37, which generally constitute a Darlington amplifier or pair, are nonconducting so that silicon controlled rectifier 27 receives no gate drive and remains nonconducting.

Subsequently, timing circuit 13 functions to turn transistor 47 off and allow gating pulses by way of a resistor 63, a diode 65, Diac 43 and diode 41 to reach gate 45 of silicon controlled rectifier 27 thereby to trigger it to its conducting state. This, in turn, allows current flow through actuating coil 17 which acts to close a switch or contact pair 67 for fuel valve 19 in order to enable fuel flow to burner 21. Diac 43 breaks down at a selected voltage (approximately 16 volts with an assumed 24 volt supply or input), and at this time, the anode to cathode voltage across silicon controlled rectifier 27 also approximates the selected voltage (i.e., about 16 volts). Thus a pulse is supplied to a primary winding 69 of a transformer T1, and such pulse has a rather sharp leading edge since silcon controlled rectifier 27 is gated to its conducting state midway in the positive half cycle of the supply voltage. During negative half cycles of the supply voltage (i.e., when power terminal 33 is positive relative to power terminal 31), a capacitor 71 drains its charge through actuating coil 17 so as to maintain fuel valve contacts 67 closed, and on the next positive half cycle, a current surge recharges the capacitor and again pulses primary winding 69 of transformer T1.

The spark for igniting the fuel at fuel burner 21 is generated by discharging a capacitor 73 through a primary winding 75 of another transformer T2 having a secondary winding 77 coupled to spark probe 25. While the transformer T1 could, for example, be a one to one isolation transformer, transformer T2 preferably has a high turns ratio to generate a high voltage pulse in its secondary winding 77 which is sufficient to jump the desired spark gap. Capacitor 73 is part of a voltage doubler which also includes a capacitor 81 and a pair of diodes 83, 85, and such voltage doubler effectively places a charge on capacitor 73 which is close to, but slightly less than, twice the peak value of the applied line voltage. With capacitor 73 charged, the sharp leading edge of the pulse applied to primary winding 69 is transmitted by way of a secondary winding 79 to a gate 87 of yet another controlled switching device, such as silicon controlled rectifier 89; therefore, this pulse enables silicon controlled rectifier 89 to effect the discharge of capacitor 73 through primary winding 75 of transformer T2 thereby to induce the high voltage in secondary winding 77 of the transformer necessary for providing the desired ignition spark. Such a spark will be provided for each pulse supplied to primary winding 69. As discussed hereinafter, it may be noted that if silicon controlled rectifier 27 is always conducting, the sine wave voltage on primary winding 69 of transformer T1 is not adequate to gate silicon controlled rectifier 89.

Assuming the spark so generated is effective to ignite the fuel at fuel burner 21, the impedance between flame detector probe 23 and ground (or other point or reference potential) diminishes, and the base current for transistor 35 flows through this flame impedance so as to turn transistor 37 to its conducting state and deliver a constant d.c. gate current to gate 45 of silicon controlled rectifier 27. As a result, this constant d.c. gate current turns on silicon controlled rectifier 27 generally at "voltage zero" so as to deprive primary winding 69 of transformer T1 of a pulse, and thus the spark generation ceases. Therefore, a spark will occur only with transistor 37 nonconducting and transistor 47 nonconducting. A diode 91 is included in the circuitry to conduct when the field in its associated transformer T1 collapses, and a pair of resistors 93, 95 are selected so that the pulse in primary winding 69 of transformer T1 triggers silicon controlled rectifier 89 while the simple sine wave does not.

When voltage is initially applied to the circuit or control system 11, a capacitor 97 charges by way of a diode 98 and functions as a direct current supply source for timing circuit 13 and flame detecting circuit 15. A zener diode 99 effects a voltage drop in control system 11, and another zener diode 101 functions as a voltage regulator therein since transistor 37 needs a higher voltage (i.e., the sum of the two zener voltages) for adequate flame detection response.

Initially, a transistor 103 is in its nonconducting state with a capacitor 105 discharged, and a pair of transistors 107, 109 are conducting to rapidly charge another capacitor 111. A pair of resistors 113, 115 are of relatively low value. A transistor 117 is conducting and functions to hold another transistor 119 in its nonconducting state. Since transistors 119, 121 generally constitute a Schmitt trigger, transistors 47, 121 and another transistor 123 are all conducting, and as previously mentioned, conduction by transistor 47 prevents the application of the enabling pulses to gate 45 of silicon controlled rectifier 27. Therefore, by creating a short time delay in this manner, relay coil 51 is afforded adequate time to be enabled and effect the closing of contacts 58 and 61, as previously described.

Transistors 103, 107 generally constitute another Schmitt trigger, and in one embodiment of the invention after a selected time period (about five seconds), capacitor 105 charges sufficiently to enable transistor 103 thus causing transistors 107, 109, 117 to go to their nonconducting state. Capacitor 111 now begins discharging by way of a resistor 125 and also by way of a pair of resistors 127, 129, the base to emitter circuit of transistor 119, and a resistor 131. At this time, transistor 119 is, of course, conducting, and transistors 47, 121, 123 are in their nonconducting state thereby to permit silicon controlled rectifier 27 to receive gating pulses at its gate 45 each time Diac 43 breaks down to its conducting state.

Assuming ignition of the fuel at fuel burner 21 is not achieved, capacitor 111 continues to discharge thereby ultimately resetting Schmitt trigger 119, 121 so that transistor 119 thereof is nonconducting and transistor 121 thereof, as well as transistors 123 and 47, are in their conducting state to again shunt the gating pulses to ground. If on the other hand ignition is achieved, silicon controlled rectifier 27 is held in its conducting state by current flow through transistor 37 of the Darlington pair and a voltage dividing resistor network 133–39, and the voltage at the junction of the collector of transistor 37 and a resistor 133 is fed back by way of a diode 135, another diode 137 and resistor 113 to replenish any loss of charge on capacitor 111.

In the event of flame failure at fuel burner 21, capacitor 111 has sufficient charge to hold transistor 47 off for its usual lock out time period allowing for an attempt at reignition. As described previously, if reignition fails, transistor 47 will turn on at the end of this lock out time.

Other circuit elements function in typical straightforward manner. A diode 139 provides a rapid discharge route for capacitor 105 in the event that power fails, and a capacitor 141 functions as a noise filtering element. A diode 143 is optionally present to provide protection for transistor 109 if the feedback voltage should happen to exceed the zener voltage of zener diode 101. Capacitor 145 similarly provides a noise filtering function. The remaining elements are, as a rule, present for normal transistor biasing functions.

In summary, a sequence of events must occur before operation of control system 11 may be effective to ignite fuel supplied to fuel burner 21. For instance, silicon controlled rectifier 27 must be nonconducting and transistor 47 conducting before relay coil 51 can be energized to move blade 58 into making engagement with line 61. Transistor 47 must then turn off to start the supply of enabling pulses to gate 45 of silicon controlled rectifier 27. If transistor 47 is continuously on or off no start-up will occur. Thus if the transistor 47 is off gate pulses wil arrive at gate 45 prior to relay 51 actuating blade 58, and current flow through silicon controlled rectifier 27 will be by way of resistor 53 and line 59 thus precluding energization of actuating coil 17. Similarly, if transistor 47 is shorted or always conducting, lock out continues and no start will occur.

REPRESENTATIVE COMPONENT VALUES FOR THE EXEMPLARY CIRCUIT

| | |
|---|---|
| Resistors: | |
| R3 | 68K |
| R5, R7, R12 | 22K |
| R8 | 47K |
| R9 | 150K |
| R10 | 10K |
| 113 | 1K |
| 115 | 10K |
| 127 | 10K |
| 129 | 100K |
| R22 | 47K |
| R23 | 15K |
| R25, R27, R31 | 10K |

-continued

REPRESENTATIVE COMPONENT VALUES FOR THE EXEMPLARY CIRCUIT

| | |
|---|---|
| 131 | 5.6K |
| R32 | 8.2K |
| 63 | 1.5K |
| R39 | 1K |
| R40 | 10K |
| R44 | 2.2 Meg |
| R45 | 10K |
| 133 | 4.7K |
| 39 | 1K |
| 93 | 1.8K |
| 95 | 1K |
| 53 | 100 OHMS |
| Capacitors: | |
| 105 | 47 Mfd. |
| 141 | 0.1 Mfd. |
| 97 | 100 Mfd. |
| 145 | 0.001 Mfd. |
| 71 | 10 Mfd. |
| 73 | 5 Mfd. |
| 81 | 50 Mfd. |
| 57 | 100 Mfd. |
| Zener Diodes: | |
| 99, 101 | 9.1 Volt Zener Diode |
| Diac: | |
| 43 | ST-4 |
| Silicon Controlled Rectifiers: | |
| 27, 89 | C106F, C106A respectively |
| Diodes: | |
| 139, 137, 143, 65, 98, 135 91, 85, 83, 55 | IN5059 or similar |
| Transistors: | |
| 103, 107, 117, 119 121, 47 | 2N5172 |
| 109, 123, 35 | 2N6076 |
| 37 | 2N6225 |
| Relays: | |
| 17 | Cornell-Dublier 603-24V |
| 51 | SIGMA 78REI-24DC |
| Transformers: | |
| 75–77 | 300:1 Ratio |
| 69–79 | 1:1 Ratio |
| Fuse: | |
| 49 | ½ AMP |

From the foregoing it is now apparent that a novel control system or circuit 11 has been described meeting the objects and advantages set out hereinbefore as well as others. Numerous modifications will suggest themselves to those having ordinary skill in the art, and it is contemplated that such modifications may be made without departing from the spirit of the invention or scope thereof as set out in the claims which follow.

What we claim as new and desire to secure by Letters Patent of the United States is:

1. A control system for a fuel burner having a fuel flow control valve and adapted to be operative from a power source comprising:

means for actuating the control valve to effect flow of fuel from the burner;

means for igniting fuel emitted from the burner;

means for indicating the presence of a flame at the burner;

a controlled switching device;

means for connecting said actuating means and said controlled switching device to the power source to effect energization of said actuating means when said controlled switching device becomes conductive;

means responsive to said indicating means and the indication of the presence of a flame at the burner for continuously enabling said controlled switching device;

means for selectively supplying enabling pulses to said controlled switching device; and timing means for selectively preventing the application of the enabling pulses to said controlled switching device.

2. A control system as set forth in claim 1 wherein said timing means includes another controlled switching device which, when enabled, conducts to bypass the enabling pulses from said first named controlled switching device.

3. A control system as set forth in claim 1 wherein said timing means is operable generally during a first time interval following initial energization of said control system to prevent the application of the enabling pulses to said controlled switching device, and during a second time interval after the first time interval to allow the application of the enabing pulses to be controlled switching device, and during a third still later time interval to again prevent the application of the enabling pulses to said controlled switching device.

4. A control system as set forth in claim 3 wherein said timing means includes another controlled switching device which is nonconducting during the second time interval and which is enabled into conduction during the first time interval and the third time interval to bypass the enabling pulses from said first named controlled switching device.

5. A control system as set forth in claim 2 wherein said other controlled switching device comprises a transistor having a collector-emitter circuit coupled between said supplying means and a point of reference potential, and said first named controlled switching device comprises a gate controlled switch with a gate thereof coupled to the junction between said other controlled switching device and said supplying means.

6. A control system as set forth in claim 5 wherein the coupling between a junction between said other controlled switching device and said supplying means comprises a diode connected to allow enabling pulses to reach said gate of said gate controlled switch when said transistor is nonconducting and to allow said supplying means to maintain said gate control switch conducting even though said transistor is conducting.

7. In a control system for a fuel burner having fuel flow control valve enabling means, a controlled switching device, means for energizing a fuel igniting system adapted to be connected in series to an electrical source, and a control circuit; the improvement wherein said control circuit comprises means for selectively supplying enabling pulses to said controlled switching device to energize said fuel igniting system, and timing means for selectively preventing the application of the enabling pulses to said controlled switching device.

8. The structure as set forth in claim 7 wherein said timing means includes another controlled switching device which, when enabled, conducts to bypass the enabling pulses from the first controlled switching device.

9. The structure as set forth in claim 8 further comprising means responsive to the presence of a flame at the burner to provide a continuous enabling signal to said first named controlled switching device even when said other controlled switching device is conducting.

10. The structure as set forth in claim 7 wherein said timing means is active during a first time interval following initial energization of the control circuit to prevent the application of enabling pulses to said controlled switching device, during a second subsequent time interval to allow the application of the enabling pulses to said controlled switching device, and during a third still later time interval to again prevent the application of the enabling pulses to said controlled switching device.

11. The structure as set forth in claim 10 wherein said timing means includes another controlled switching device which, when enabled, conducts to bypass the enabling pulses from the controlled switching device.

12. The structure as set forth in claim 11 wherein said other controlled switching device comprises a transistor having a collector-emitter circuit connected between said supplying means and a point of reference potential, and said first named controlled switching device comprises a gate controlled switch with a gate thereof coupled to a junction between said other controlled switching device and said supplying means.

13. The structure as set forth in claim 12 wherein the coupling between said other controlled switching device and said supplying means comprises a diode which allows enabling pulses to reach said gate of said gate controlled switch when said transistor is nonconducting.

* * * * *

UNITED STATES PATENT AND TRADEMARK OFFICE

CERTIFICATE OF CORRECTION

PATENT NO. : 4,070,144

DATED : January 24, 1978

INVENTOR(S) : Alvin D. Wyland and Jaykishan C. Patel

It is certified that error appears in the above-identified patent and that said Letters Patent are hereby corrected as shown below:

Col. 1, line 40, delete "3,920.376" and insert --3,920,376--.

Col. 3, line 11, after "control" insert --system 11 to prevent the application of the enabling--.

Col. 5, line 20, delete "resistor" and insert --resistive--.

Col. 7, line 15, delete "be".

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*